United States Patent [19]

Eddy

[11] Patent Number: 4,667,594

[45] Date of Patent: May 26, 1987

[54] METHOD AND APPARATUS FOR PRINTING THE INTERIOR OF HOLLOW ARTICLES

[76] Inventor: Albert W. Eddy, R.R. 1 Box 79, Winona, Minn. 55987

[21] Appl. No.: 727,921

[22] Filed: Apr. 29, 1985

[51] Int. Cl.[4] ..... B41F 17/00; B41F 17/20

[52] U.S. Cl. ..... 101/35; 101/426; 101/379; 118/254; 156/423; 427/230

[58] Field of Search ..... 101/35, 41, 426, 368, 101/379; 118/205, 215, 214, 254; 427/230; 156/423

[56] References Cited

U.S. PATENT DOCUMENTS

| | | | |
|---|---|---|---|
| 2,071,336 | 2/1937 | Glenn et al. | 101/35 |
| 2,201,302 | 5/1940 | Rowe | 101/41 X |
| 2,578,329 | 12/1951 | Von Hote | 156/423 |
| 2,879,740 | 3/1959 | Mahon et al. | 101/35 X |
| 3,404,623 | 10/1968 | Watkin | 101/35 |
| 3,748,049 | 7/1973 | Knupfer et al. | 118/215 X |
| 3,871,293 | 3/1975 | Valiela | 101/41 |

FOREIGN PATENT DOCUMENTS

| | | | |
|---|---|---|---|
| 116808 | 7/1946 | Sweden | 101/35 |

*Primary Examiner*—Clifford D. Crowder

*Attorney, Agent, or Firm*—Merchant, Gould, Smith, Edell, Welter & Schmidt

[57] ABSTRACT

A method and apparatus for applying a printed image to an interior surface of a hollow article is disclosed. The method involves using a mandrel with an expansible block having an outer surface for transferring an image, and means for exerting a force on the block to cause the block to expand in the cavity of the hollow article to effect image transfer. Use of mechanical compression and fluid pressure as alternatives for expanding the block are disclosed.

7 Claims, 17 Drawing Figures

METHOD AND APPARATUS FOR PRINTING THE INTERIOR OF HOLLOW ARTICLES

TECHNICAL FIELD OF THE INVENTION

The present invention pertains generally to the field of printing and label applying apparatus and methods, and, more particularly, to apparatus and methods for applying print or labels to unusual surface shapes. The method and apparatus of this invention is designed primarily for use in application of printed matter and/or labels to an interior concave surface of a hollow article.

BACKGROUND OF THE INVENTION

In the printing industry, there is an unfilled need to be able to apply printed matter, either in the form of ink or labels, to a interior surface of hollow articles. One important example of this need is in the tape business, where one of the best places to place identification information is on the inner surface of the hollow cylindrical tape core about which a roll of tape is wound.

The present invention meets this need in an economical, high print quality system which can handle relatively high rates of printing of interior surfaces of hollow circularly cylindrical articles, as well as other surfaces such as interior surfaces of hollow rectangular, elliptical, triangular, and other regular or irregular shapes.

SUMMARY OF THE INVENTION

In the apparatus and method of the present invention, a label or printed matter is applied to the outer surface of a unitary expansible printing block sized slightly smaller than the interior dimensions of the article to be printed. This expansible block is then moved into the cavity of the article to be printed. Following that step, the expansible printing block is expanded to contact the inner surface of the hollow article to be printed to transfer either the label or printed matter to the article surface.

In certain classes of preferred embodiments of the invention, this is accomplished by utilizing a silicone rubber printing block with mechanical pressure plates at each end mounted on a shaft which holds the printing assembly. The shaft and printing block are moved into the interior cavity of the article to be printed, or vice versa, and into contact with a mandrel stop which creates pressure between the pressure plates. This in turn expands the exterior surface of the printing block to contact the article to be printed.

In certain other classes of embodiments, the pressure between the pressure plates may be created by a pressure plate linkage attached to a cam actuator so that a separate stop member is not necessary.

In certain other classes of embodiments, the expansible member may be driven by an air pressure line which runs internal to the mounting shaft for the block.

In apparatus which performs a label applying function, the external surface of the mandrel may have a large number of vacuum apertures attached to a vacuum line internal to the mounting shaft of the block. The vacuum drawn through these apertures may be used to hold the label in place until the block is placed within the hollow article and expanded to cause the adhesive on the label to contact the inner surface of the article to which the label is to be applied.

In some cases, it may be desirable to use shaping rods internal to the expansible printing block to limit the distortion of the exterior surface upon expansion. In addition, it may be desirable to apply a predistorted image to compensate for the small amount of distortion which may occur upon expansion of the block during the printing process.

These and other important features of the present invention, together with more detailed embodiments which have additional advantages, are described below in more detail in the specification and drawings.

DETAILED DESCRIPTION OF THE INVENTION

Figure 1:
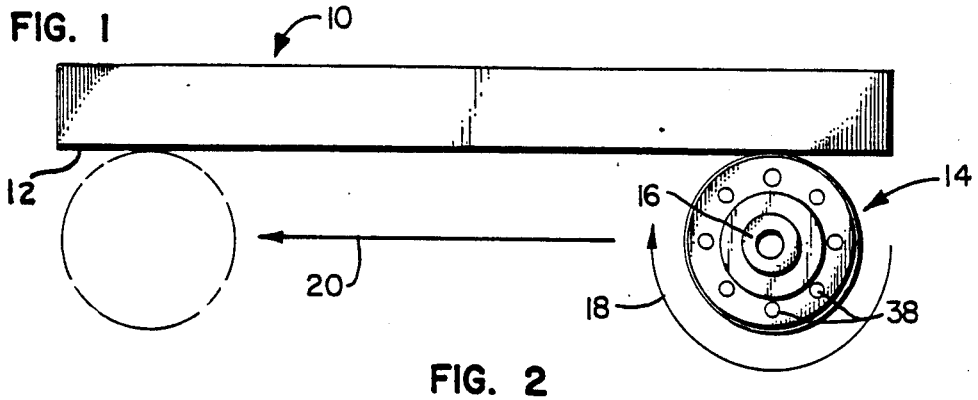
FIG. 1 is an elevational view showing a first step in the method according to certain embodiments of the present invention in which ink is applied to an exterior expansible surface of a printing block.
Figure 2:
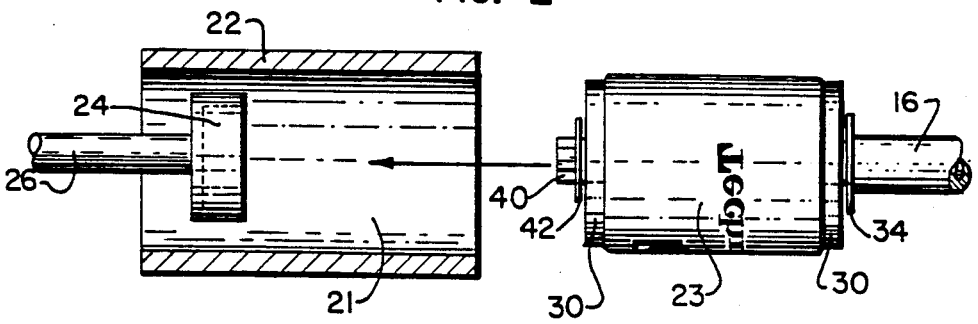
FIG. 2 is an elevational view of a second step in the method partially shown in FIG. 1 illustrating the movement of the printing mandrel into the article to be printed.
Figure 3:
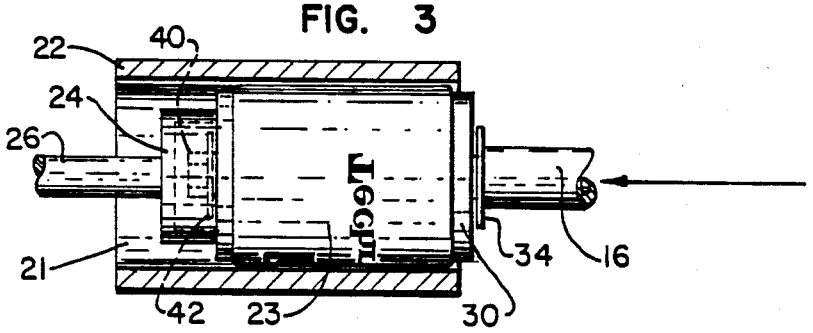
FIG. 3 is an elevational view of a third step in the method partially shown in FIGS. 1 and 2 illustrating the movement of the mandrel into the cavity of the article to be printed.
Figure 4:
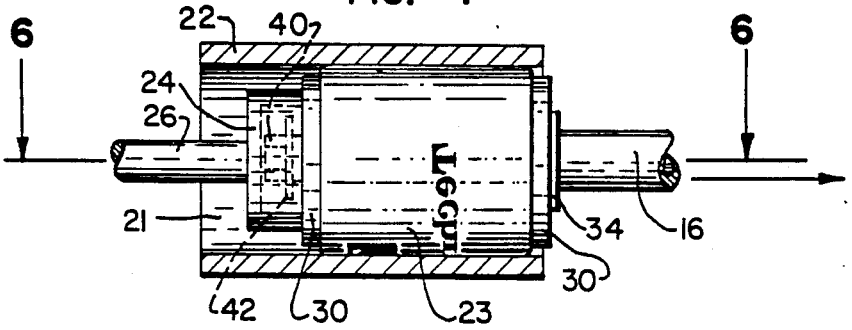
FIG. 4 is an elevational view of a subsequent step in the method partially shown in FIGS. 1, 2 and 3 in which the printing block is expanded to contact and transfer printed matter to the interior surface of the article to be printed by means of compression forces against the ends of the expansible block.

FIG. 1 shows an inking screen 10 having an inking surface 12. Inking screen 10 may be a conventional silk screen printing screen, or pad printing apparatus used for applying printing ink or printing paint to the block utilized in subsequent steps of this invention. Also shown in FIG. 1 is a circularly cylindrical mandrel assembly generally designated 14. Mandrel assembly 14 may be mounted on a shaft 16 which carries the mandrel for various printing operations. In FIG. 1, mandrel assembly 14 rolls across with its exterior circular cylindrical surface in contact with inking surface 12 to receive print to be applied as shown in arrows 18 and 20.

Following the inking step, mandrel assembly 14 is moved into contact with the interior surface of a hollow article to be printed 22. In the examples shown in FIGS. 1 through 5, article 22 is a circularly cylindrical article, and the surface to be printed is an inner concave circularly cylindrical surface 21 of article 22. Shown particularly in FIGS. 2 through 6 are apparatus and steps utilized in performance of the method once the inking is complete.

Mandrel assembly 14 includes an expansible printing block 23 carried by shaft 16 between a pair of pressure plates 30 which have frustoconical projections inwardly of their outer ends. (This is shown in more detail in FIG. 7.) As mandrel assembly 14 moves into the cavity of cylindrical article 22, it contacts a mandrel stop 24 positioned on a stop shaft 26. Mandrel stop 24, together with the movement of mandrel shaft 16, exerts pressure on pressure plates 30 which is in turn transferred to printing block 23. This is shown sequentially in FIGS. 2, 3 and 4 which illustrates the compression of block 23 between plates 30 as plates 30 are compressed by a positioning washer or stop 34 and mandrel stop 24.

This mechanical compression results in expansion of the exterior circular cylindrical surface of block 23 so that contact between that surface and inner surface 21 of article 22 is effected. (Shown particularly in FIG. 4) At this point, the printed image is transferred to inner surface 21 of hollow article 22.

Figure 5:
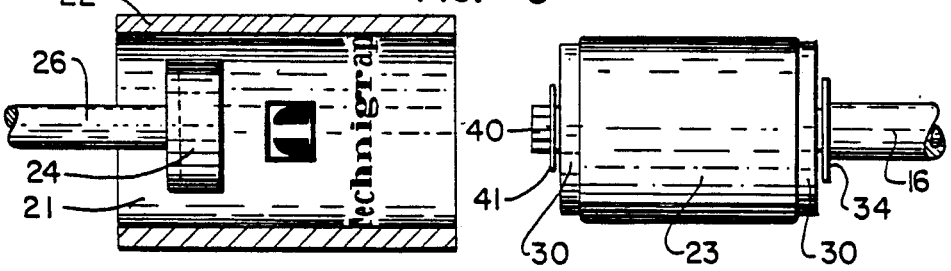
FIG. 5 is an elevational view of the final step in the process partially shown in FIGS. 1 through 4 in which the mandrel is removed following application of the printed matter to the interior surface of the article to be printed.

FIG. 5 shows retraction of mandrel 14 from hollow article 22 following completion of the method. During the method, article 22 will of course be supported by conventional mechanical support structure. (not shown)

Figure 6:
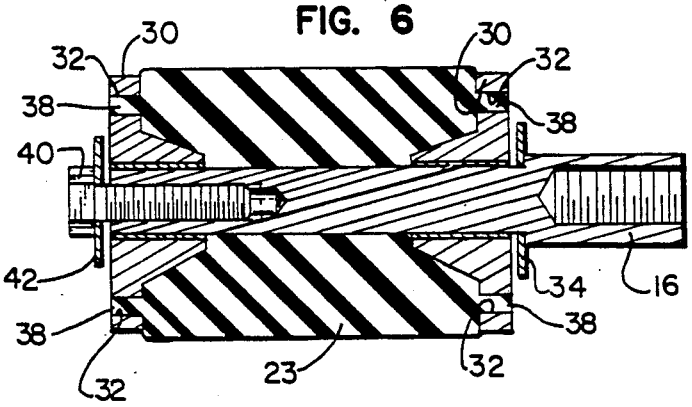
FIG. 6 is a sectional view along the lines 6—6 of FIG. 4.
Figure 7:
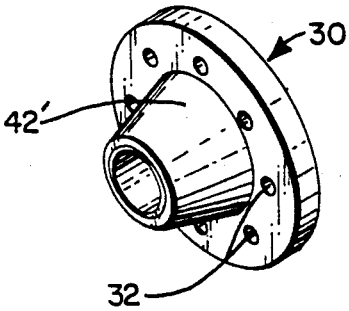
FIG. 7 is a perspective view showing the construction of the pressure plates according to one embodiment of the present invention.

FIGS. 6 and 7 show details of construction of the mandrel according to the embodiment of the invention shown in FIGS. 1 through 5. In FIG. 6, block 23 is shown in section. Block 23 may be molded of silicone rubber in a cylindrical shape. Preferably, block 23 will have external dimensions close to those of the hollow article to be printed and will expand only a short distance, e.g. 0.010–0.030 inch, during the printing process. This limits distortion and is also necessary to provide a firm exterior surface on which to apply the printed matter.

In some embodiments of the invention, block 23 will have external projections 38 which extend into mating apertures 32 in each of pressure plates 30. In fact it may be preferred to mold the silicone rubber with plates 30 in place to create a unitary block. Also shown in FIG. 6 is a sectional view of shaft 16, together with a mounting bolt 40 and associated mounting washer 42 which retain the block and plate structure on shaft 16.

FIG. 7 shows details of construction of pressure plates 30. In particular, apertures 32 into which projections 38 extend are shown as well as a frustoconical projection 42' which extends centrally of plate 30. Frustoconical projection 42' is designed primarily to promote an even expansion of the exterior convex surface of block 23 during the mechanical compression steps previously discussed.

It will be apparent to persons of skill in the art that this method is not limited to a particular interior article shape.

In addition to not being limited to any particular shape, the method and apparatus of the present invention is not limited to a specific process for applying the printing ink or paint to the mandrel, or any specific printing block structure. It has been found that a silicone rubber with a durometer in the range of 30 to 60 is preferred. Use of this kind of a method and apparatus should allow printing on individual heads at faster than 1 article per second.

Figure 8:
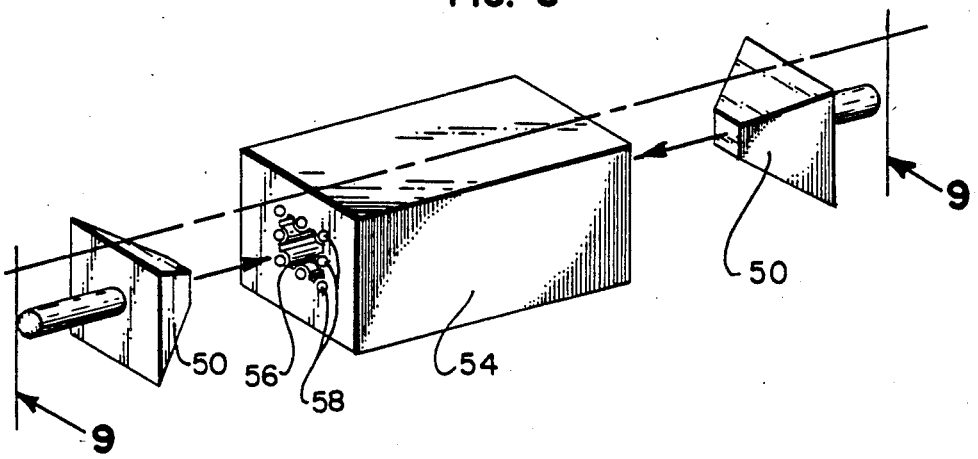
FIG. 8 is a perspective view diagrammatically showing portions of the structure of a rectangular external surface printing block constructed according to one embodiment of the present invention.
Figure 9:
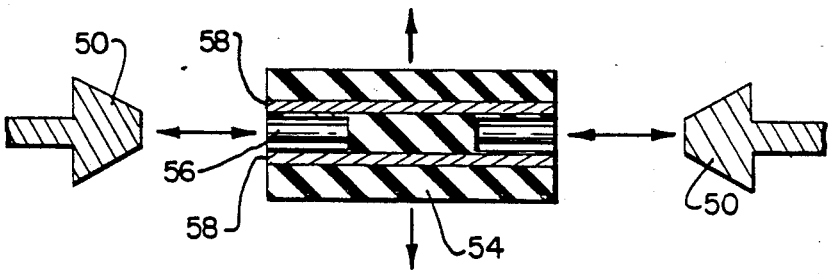
FIG. 9 is a sectional view along the line 9—9 of FIG. 8.

FIGS. 8 and 9 illustrate, in simplified form, an alternate structure which may be utilized for printing the internal hollow surface of a rectangularly cylindrical article. Shown in FIGS. 8 and 9 in a schematic form are a pair of frustotetrahedral blocks 50 which act in a manner similar to plates 30 against a rectangular printing block 54. Printing block 54 has a pair of axial cavities 56 into which blocks 50 fit and extend to create an expansive pressure on block 54. Molded into block 54 along its length in a rectangularly cylindrical pattern are a plurality of shaping rods 58, which are rigid relative to block 54. As pressure blocks 50 move inward into cavities 56, rods 58 ride up the individual tetrahedral surfaces of blocks 50 and create a substantially uniform expansion of the exterior surface of block 54. This minimizes distortion during the expansion step of the process. It may be also desirable to experimentally develop a predistortion of the printing to enhance the quality of the final image in use of this process.

Figure 10:
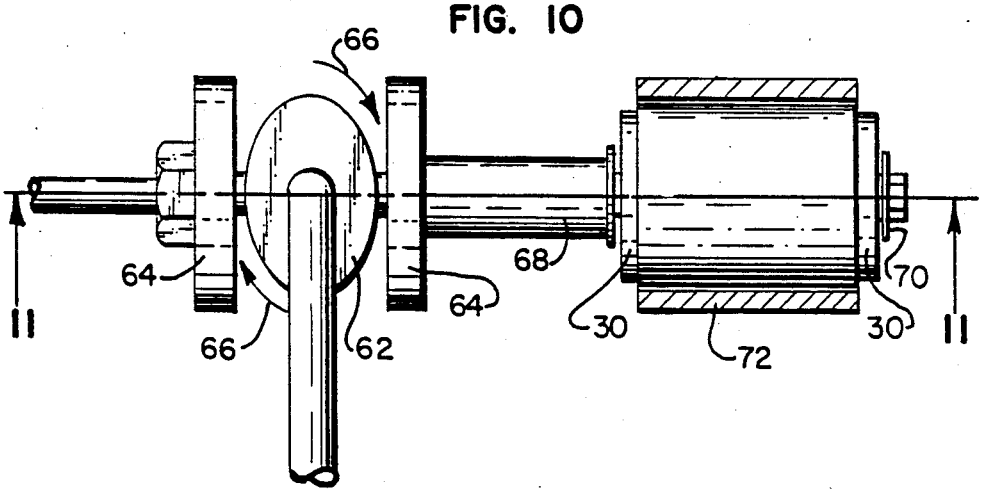
FIG. 10 is an elevational view showing apparatus for performing the method similar to FIGS. 1 through 5 utilizing alternative apparatus for applying pressure to the pressure plates used to compress the expansible printing block.
Figure 11:
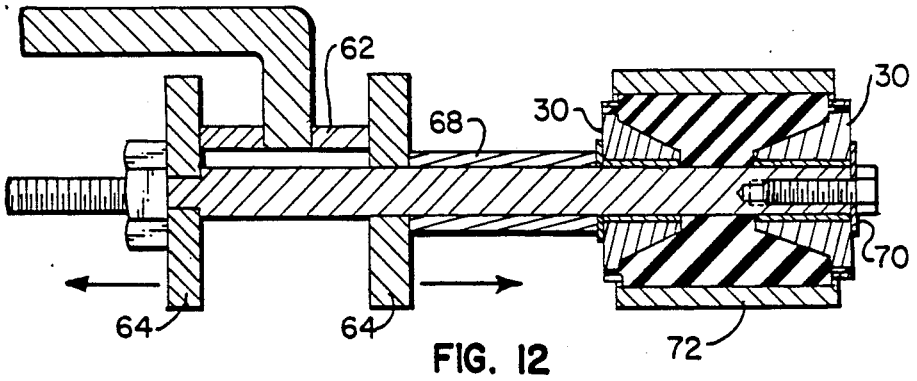
FIG. 11 is a sectional view along the line 11—11 of FIG. 10.

FIGS. 10 and 11, as previously mentioned, illustrate an alternate means of compression of the block and plate structure to create mechanical pressure during the printing step in the inventive method. In FIGS. 10 and 11, a cam actuator 62 acts between plates 64 by rotation in a direction shown by arrows 66. During this rotation, the right hand plate (as shown in FIG. 10) is movable along the mandrel axis to shift a pressure plate linkage 68 into contact with one of plates 30. Assuming proper shape and size of the cam and other components, this creates sufficient pressure between blocks 30, linkage 68 and washer 70 to create an outward expansion of block 72 during the printing step. The advantage of this structure is that it permits use of the method in cup-shaped hollow articles and eliminates the need for separate support of a mandrel stop.

Figure 12:
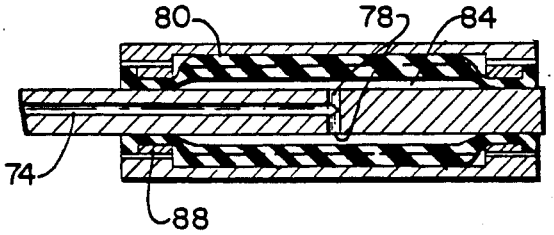
FIGS. 12, 13 and 14 are sectional views showing alternate embodiments of expansible printing blocks used for specific configurations of hollow articles in which air pressure is used to expand the printing block.
Figure 13:
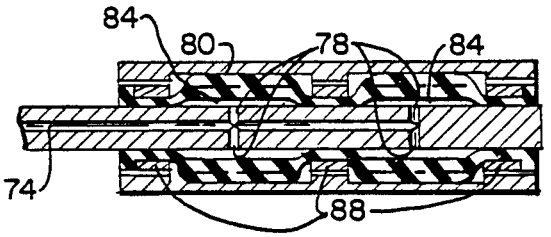
Figure 14:
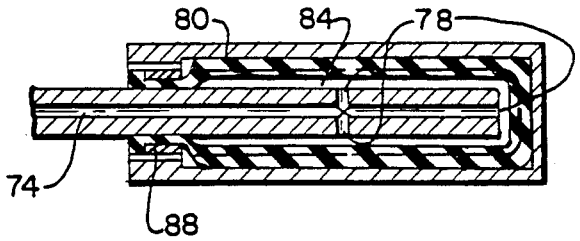

In FIGS. 12, 13 and 14, an alternate embodiment is shown which creates its expansion by means of air pressure. In these Figures, the mandrel shaft has a hollow air pressure line 74 with apertures 78 along its length and an expansible block 80 sealed to the shaft carrying the air pressure line. Block 80 is formed with an air pressure cavity 84 along the critical length of block 80 proximate the surface to be expanded. In operation, upon application of air pressure, there is an expansion of block 80 in the vicinity of air pressure cavity 84 which causes the expansible portion of block 80 to contact the surface to be printed. FIGS. 12, 13 and 14 illustrate use of this system with three (3) different types of hollow articles.

In FIG. 12, the hollow article is a circularly cylindrical article with reduced diameter sections at its opposite ends. In FIG. 13, there is a central ridge 88 which creates 2 (two) independent circularly cylindrical sections to be printed. The structure for use in that case is modified to create two (2) separate portions of block 80 which expand into contact with the surfaces to be printed. FIG. 14 shows a cup-shaped version in which one end of the article to be printed is closed, and it is desired to print the closed end as well as the circularly cylindrical ends.

Figure 15:
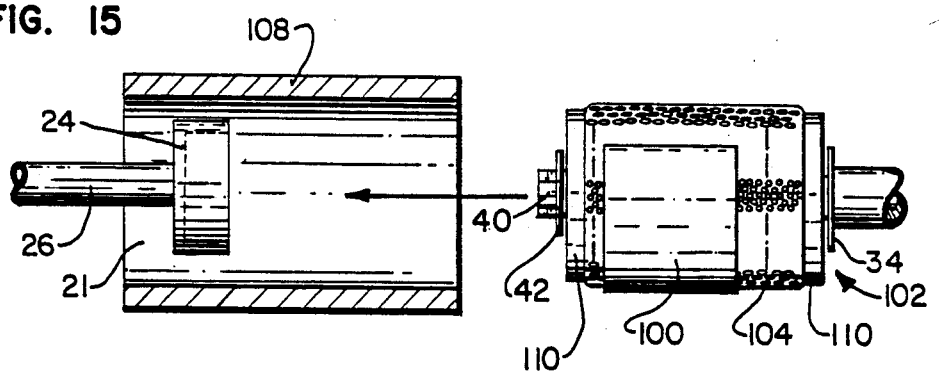
FIGS. 15, 16 and 17 are partially section views showing a certain class of embodiments of the invention in which the inventive method and apparatus is used to apply labels to the interior surfaces of hollow articles.
Figure 16:
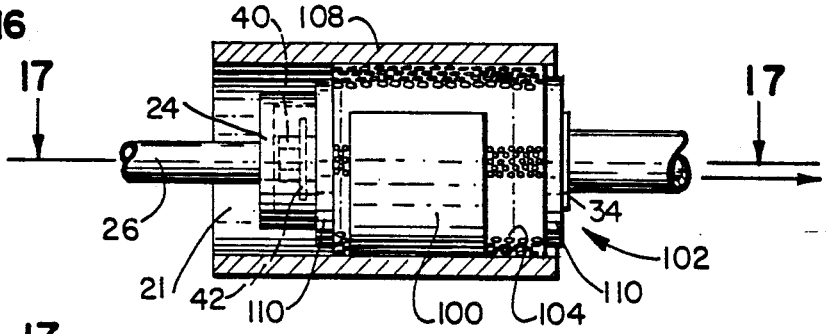
Figure 17:
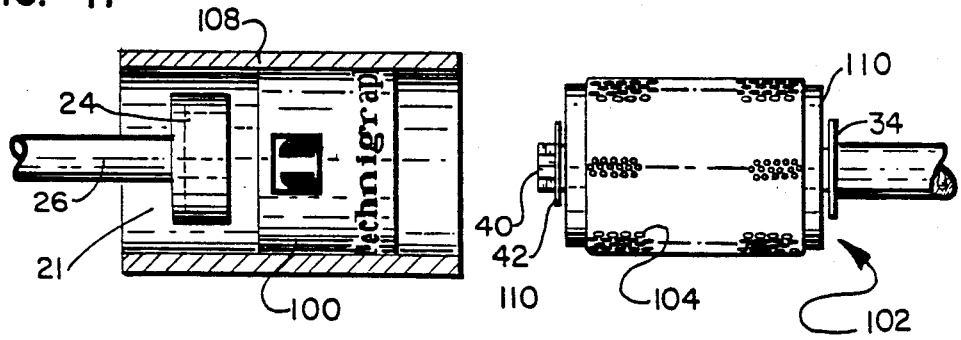

FIGS. 15, 16 and 17 show a method similar to that described for FIGS. 1 through 5, where application of an adhesive label is desired. In FIG. 15, an adhesive label 100 is held adhesive side outward on a mandrel generally designated 102 which carries an expansible block 104. Expansible block 104 has a large number of apertures about its exterior surface which are in contact with an exterior vacuum line running through the mandrel shaft to which block 104 is affixed. In usage, the mandrel is brought into contact with the label, and a vacuum is drawn to temporarily hold the label in place on the mandrel during the process. The mandrel is then moved inwardly of article 108 to which label attachment is desired, and compression of plates 110 occurs in a manner similar to that previously described for FIGS. 1 through 5. This compression causes an expansion of expansible block 104, which in turn brings the adhesive side of the label into contact with the inner surface of article 108. The label readily adheres to that inner surface, and as the pressure is released, the mandrel may be withdrawn. This leaves article 108 with the label applied on its inner surface. In some embodiments, it may be desirable to apply positive pressure in the vacuum line as part of the expansion step to provide additional pressure to adhere the 5 label to the interior surface of the article.

Although the present invention has been described above in preferred forms, those skilled in the art will readily appreciate that various modifications may be made to it without departing from the spirit and scope of the invention, which is bounded only by the claims of the application itself.

What is claimed is:

1. A method of applying a printed image to an interior surface of a cavity in a hollow article to be printed, comprising the steps of:

(a) applying the image to an expansible outer surface on a block having a pair of opposed cavities along one axis, the block sized smaller than the cavity yet conforming closely to the cavity surface;

(b) inserting the block into the cavity into alignment with the surface to be printed;

(c) controllably expanding the block outer surface in a manner which minimizes distortion to contact the interior surface so that the image is transferred thereto, the controllable expansion of the block involving mechanically compressing the block along the axis thereof by moving a pair of plates with conical sections into contact with said cavities; and (d) contracting the block outer surface to permit withdrawal of the block from the cavity.

2. The method of claim 1 wherein the conical sections are frustums of right circular cones.

3. The method of claim 1 wherein the conical sections are frustums of tetrahedral conical sections.

4. Apparatus for applying a printed image to an interior surface of a cavity in an article to be printed, comprising:

(a) an expansible block having an outer surface capable of transferring an image, the block including a pair of cavities, each of which is proximate an associated one of a pair of opposed plates which contact opposite sides of the block along a force axis, each plate including a mating conical section which extends inwardly of an associated cavity;

(b) means for exerting a force on the block to expand the outer surface into contact with said interior surface, said means for exerting a force including said pair of opposed plates;

(c) means for applying an image to be transferred to said outer surface; and (d) means for releasing said force to eliminate said expansion so that said block may be removed from said cavity without interior surface contact.

5. The apparatus of claim 4 wherein said block includes a plurality of relatively rigid shaping rods which extend generally parallel to the force axis and are embedded in the block spaced about the periphery of said cavities.

6. The apparatus of claim 4 wherein said block is formed of silicone rubber.

7. The apparatus of claim 6 wherein said silicone rubber has a durometer range of 30 to 60.

* * * * *